US011965515B2

(12) United States Patent
Zhang

(10) Patent No.: US 11,965,515 B2
(45) Date of Patent: Apr. 23, 2024

(54) CENTRIFUGAL COMPRESSOR AND REFRIGERATION SYSTEM

(71) Applicant: Carrier Corporation, Palm Beach Gardens, FL (US)

(72) Inventor: Wei Zhang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/839,734

(22) Filed: Jun. 14, 2022

(65) Prior Publication Data

US 2022/0403850 A1 Dec. 22, 2022

(30) Foreign Application Priority Data

Jun. 18, 2021 (CN) ..... 202110677256.6

(51) Int. Cl.
*F04D 17/10* (2006.01)
*F04D 25/06* (2006.01)
(Continued)

(52) U.S. Cl.
CPC ..... *F04D 17/10* (2013.01); *F04D 25/06* (2013.01); *F04D 29/051* (2013.01);
(Continued)

(58) Field of Classification Search
CPC ..... F04D 17/10; F04D 25/06; F04D 29/056; F04D 29/057; F04D 29/0513; F04D 29/083; F04D 29/701
(Continued)

(56) References Cited

U.S. PATENT DOCUMENTS 1,427,974 A * 9/1922 Sessions ..... F04D 13/06 277/504
4,385,768 A 5/1983 Swearingen
(Continued)

FOREIGN PATENT DOCUMENTS

DE 102012207019 A1 10/2013
JP 2009270797 A 11/2009

OTHER PUBLICATIONS

European Search Report for application EP 22178496.0, dated Nov. 14, 2022, 101 pages.

*Primary Examiner* — Kenneth J Hansen
(74) *Attorney, Agent, or Firm* — CANTOR COLBURN LLP

(57) ABSTRACT

A centrifugal compressor, including: a housing; a motor assembly disposed in the housing and a motor cavity and a motor shaft located in the motor cavity, the motor shaft having a first end and a second end extending from the motor cavity; a first impeller assembly located at the first end of the motor shaft and provided with a first labyrinth sealing mechanism; a second impeller assembly located at the second end of the motor shaft and provided with a second labyrinth sealing mechanism; a first gas bearing assembly provided between the motor cavity and the first impeller assembly; and a second gas bearing assembly provided between the motor cavity and the second impeller assembly; wherein the first labyrinth sealing mechanism is kept in gas communication with the first gas bearing assembly, and the second labyrinth sealing mechanism is kept in gas communication with the second gas bearing assembly.

9 Claims, 3 Drawing Sheets

(51) Int. Cl.

| | |
|---|---|
| ***F04D 29/051*** | (2006.01) |
| ***F04D 29/056*** | (2006.01) |
| ***F04D 29/057*** | (2006.01) |
| ***F04D 29/08*** | (2006.01) |
| ***F25B 31/02*** | (2006.01) |

(52) U.S. Cl.
CPC ..... *F04D 29/056* (2013.01); *F04D 29/057* (2013.01); *F04D 29/083* (2013.01); *F25B 31/026* (2013.01)

(58) Field of Classification Search
USPC ..... 310/90
See application file for complete search history.

(56) References Cited

U.S. PATENT DOCUMENTS

| | | | | |
|---|---|---|---|---|
| 2004/0179947 | A1 | 9/2004 | Agrawal et al. | |
| 2016/0177784 | A1* | 6/2016 | Archer | F01D 25/183 415/170.1 |
| 2020/0291953 | A1 | 9/2020 | Perevozchikov et al. | |
| 2022/0356904 | A1* | 11/2022 | Bakkestuen | F16C 32/0614 |

* cited by examiner

CENTRIFUGAL COMPRESSOR AND REFRIGERATION SYSTEM

FOREIGN PRIORITY

This application claims priority to Chinese Patent Application No. 202110677256.6, filed Jun. 18, 2021, and all the benefits accruing therefrom under 35 U.S.C. § 119, the contents of which in its entirety are herein incorporated by reference.

TECHNICAL FIELD OF INVENTION

The present invention relates to the technical field of refrigeration, in particular to a centrifugal compressor, and also relates to a refrigeration system configured with the centrifugal compressor.

BACKGROUND OF THE INVENTION

At present, centrifugal compressors gradually adopt oil-free lubrication technology to replace the original oil circuit lubrication, thereby eliminating the management of the lubricating oil system, such as oil circuit maintenance, oil return management and oil circuit system maintenance. On the other hand, oil-free lubrication also represents higher operation efficiency of the compressor and higher operation efficiency of the refrigeration system, lower vibration and noise, stable operation, greatly reduced cost, high cleanliness, and better user experience.

A gas bearing is an important method and means for the solution of oil-free lubrication of centrifugal compressors. A centrifugal compressor supported by gas bearings is composed of a housing, a volute, impellers, gas bearings, a high-speed motor and other components. During the working process, the high-speed motor is supported by gas bearings at the left and right ends, with low rotational resistance and relatively high rotational speed. In order to supply gas to the gas bearings on both sides of the high-speed motor, it is usually necessary to add a gas supply system into the centrifugal compressor, such as adding additional gas supply pipes, or drilling holes in the components of the centrifugal compressor to create gas supply channels. Such gas supply method, however, increases the manufacturing difficulty and cost of centrifugal compressors.

Therefore, there is an urgent need for a centrifugal compressor, which can solve the gas supply problem of the gas bearings without adding an additional gas supply system.

SUMMARY OF THE INVENTION

In view of the above, according to a first aspect of the present invention, a centrifugal compressor is provided, which effectively solves the aforementioned problems and problems in other aspects existing in the prior art. In the centrifugal compressor according to the present invention, the centrifugal compressor comprises: a housing; a motor assembly disposed in the housing and comprising a motor cavity and a motor shaft located in the motor cavity, the motor shaft having a first end and a second end extending from the motor cavity; a first impeller assembly located at the first end of the motor shaft and provided with a first labyrinth sealing mechanism for reducing gas leakage from one side of the first impeller assembly close to the motor cavity; a second impeller assembly located at the second end of the motor shaft and provided with a second labyrinth sealing mechanism for reducing gas leakage from one side of the second impeller assembly close to the motor cavity; a first gas bearing assembly provided between the motor cavity and the first impeller assembly; and a second gas bearing assembly provided between the motor cavity and the second impeller assembly; wherein the first labyrinth sealing mechanism is kept in gas communication with the first gas bearing assembly, such that the gas leaking from the side of the first impeller assembly close to the motor cavity is capable of being supplied to the first gas bearing assembly, and the second labyrinth sealing mechanism is kept in gas communication with the second gas bearing assembly, such that the gas leaking from the side of the second impeller assembly close to the motor cavity is capable of being supplied to the second gas bearing assembly.

In still another embodiment of the centrifugal compressor according to the present invention, the first gas bearing assembly comprises: a first bearing seat fixed between the motor cavity and the first impeller assembly; and a first radial bearing sleeved on the motor shaft and located in the first bearing seat; and the second gas bearing assembly comprises: a second bearing seat fixed between the motor cavity and the second impeller assembly; and a second radial bearing sleeved on the motor shaft and located in the second bearing seat.

In another embodiment of the centrifugal compressor according to the present invention, the second gas bearing assembly further comprises: a thrust plate fixed on the motor shaft and located between the second impeller assembly and the second radial bearing or between the motor cavity and the second radial bearing; a first axial thrust bearing disposed next to one side of the thrust plate; and a second axial thrust bearing disposed next to the other side of the thrust plate, wherein the first axial thrust bearing and the second axial thrust bearing are coaxially fixed in the second bearing seat or a second impeller housing.

In yet another embodiment of the centrifugal compressor according to the present invention, the first gas bearing assembly further comprises: a thrust plate fixed on the motor shaft and located between the first impeller assembly and the first radial bearing or between the motor cavity and the first radial bearing; a first axial thrust bearing disposed next to one side of the thrust plate; and a second axial thrust bearing disposed next to the other side of the thrust plate, wherein the first axial thrust bearing and the second axial thrust bearing are coaxially fixed in the first bearing seat or a first impeller housing.

In still another embodiment of the centrifugal compressor according to the present invention, a first wire mesh is provided between the motor cavity and the first gas bearing assembly for preventing droplets from the motor cavity from entering the first gas bearing assembly, and a second wire mesh is provided between the motor cavity and the second gas bearing assembly for preventing droplets from the motor cavity from entering the second gas bearing assembly.

In another embodiment of the centrifugal compressor according to the present invention, a first baffle plate is provided on one side of the first bearing seat close to the motor cavity for preventing droplets from the motor cavity from entering the first gas bearing assembly, and a second baffle plate is provided on one side of the second bearing seat close to the motor cavity for preventing droplets from the motor cavity from entering the second gas bearing assembly.

In yet another embodiment of the centrifugal compressor according to the present invention, the outlet pressure on one side of the first gas bearing assembly close to the motor cavity is greater than the pressure in the motor cavity, and the outlet pressure on one side of the second gas bearing assembly close to the motor cavity is greater than the pressure in the motor cavity.

In still another embodiment of the centrifugal compressor according to the present invention, the first labyrinth sealing mechanism is provided on one or more of a fixed portion of the end of the first impeller of the first impeller assembly, the first impeller housing and the first bearing seat; and the second labyrinth sealing mechanism is provided on one or more of a fixed portion of the end of the second impeller of the second impeller assembly, the second impeller housing and the second bearing seat.

In another embodiment of the centrifugal compressor according to the present invention, the first radial bearing of the first gas bearing assembly and the second radial bearing of the second gas bearing assembly are configured to be of the same size, and are symmetrically disposed on both sides of the motor shaft with respect to the motor cavity.

In yet another embodiment of the centrifugal compressor according to the present invention, the first wire mesh and the second wire mesh are configured to be of the same size, and are symmetrically disposed on both sides of the motor shaft with respect to the motor cavity.

In addition, according to a second aspect of the present invention, a refrigeration system comprising the aforementioned centrifugal compressor is further provided.

It can be appreciated that the centrifugal compressor according to the present invention, by adopting the design of combining labyrinth seal of the impeller assembly with gas bearing assembly, meets the gas supply requirements of the gas bearing assembly in a simple and economical manner without adding an additional gas supply system.

BRIEF DESCRIPTION OF THE DRAWINGS

The technical solutions of the present invention will be described in further detail below in conjunction with the accompanying drawings and embodiments, wherein.

DETAILED DESCRIPTION OF THE INVENTION

Some embodiments of the present invention will be described in detail below with reference to the accompanying drawings. It should be noted that orientation terms such as upper, lower, left, right, front, rear, inner side, outer side, top and bottom mentioned or possibly mentioned in this specification are defined relative to the configurations illustrated in the respective drawings. They are relative concepts, so they may change accordingly according to their different locations and different states of use. Therefore, these and other orientation terms shall not be construed as restrictive terms.

Figure 1:
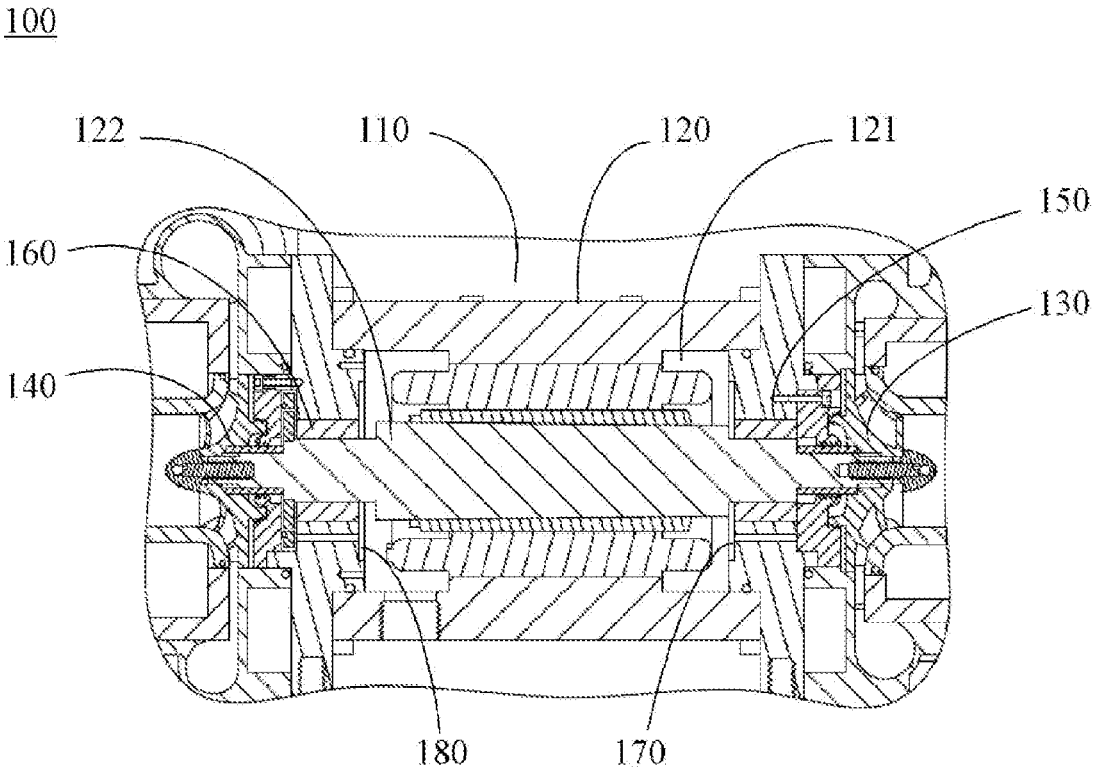
FIG. 1 shows a cross-sectional schematic view of a centrifugal compressor according to an embodiment of the present invention.
Figure 2:
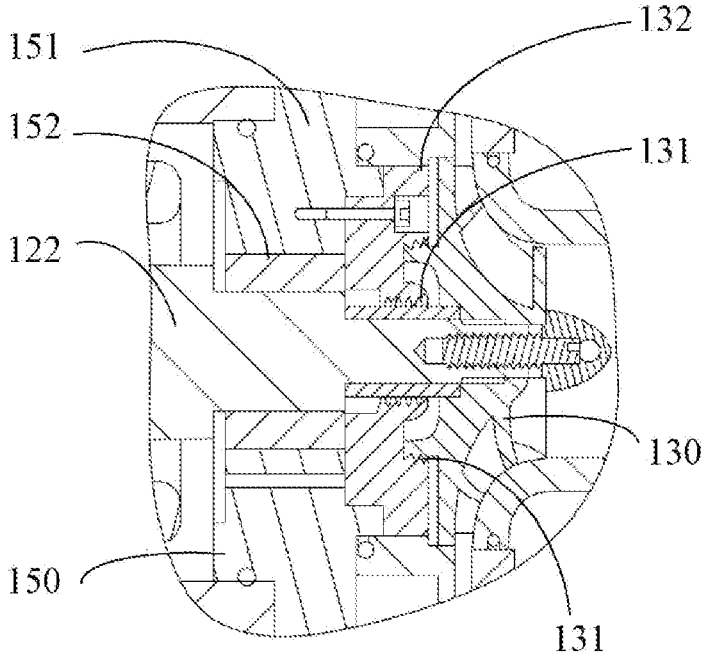
FIG. 2 shows a partially enlarged cross-sectional schematic view of the low-pressure stage comprising the first labyrinth sealing mechanism and the first gas bearing assembly of the centrifugal compressor according to FIG. 1.
Figure 3:
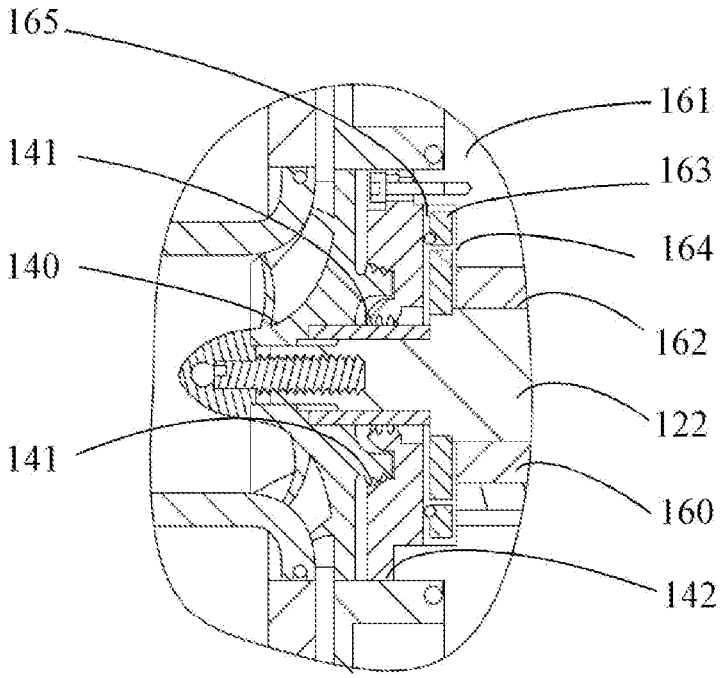
FIG. 3 shows a partially enlarged cross-sectional schematic view of the high-pressure stage comprising the second labyrinth sealing mechanism and the second gas bearing assembly of the centrifugal compressor according to FIG. 1.

As shown in FIG. 1, it schematically illustrates the structure of an embodiment of the centrifugal compressor according to the present invention in general. As can be seen from FIG. 1, the centrifugal compressor 100 is composed of a housing 110, a motor assembly 120, a first impeller assembly 130, a second impeller assembly 140, a first gas bearing assembly 150, a second gas bearing assembly 160 and other components. The motor assembly 120 is disposed in the housing 110, and comprises a motor cavity 121 and a motor shaft 122, wherein the motor shaft 122 is located in the motor cavity 121 and has a first end and a second end extending from the motor cavity 121. Referring also to FIGS. 2 to 3, the centrifugal compressor 100 comprises a first stage or a second stage of two-stage compression in a back-to-back design: a low-pressure stage compression composed of the first impeller assembly 130, and a high-pressure stage compression composed of the second impeller assembly 140, wherein the second impeller assembly 140, i.e., the impeller of the second stage, is generally smaller than the first impeller assembly 130, i.e., the impeller of the first stage, wherein the inlet of the impeller of the second stage is the outlet of the impeller of the first stage. It can be appreciated that the centrifugal compressor may also comprise a first stage or a second stage disposed in parallel in a back-to-back design, wherein the impellers of the two stages are of the same size, that is, the inlet and outlet arrangements are the same. The first impeller assembly 130 is located at the first end of the motor shaft 122, and is provided with a first labyrinth sealing mechanism 131, so as to reduce the gas leakage from the side of the first impeller assembly 130 close to the motor cavity 121, thereby limiting the gas leaking from the side of the first impeller assembly 130 close to the motor cavity 121 within a certain range. The second impeller assembly 140 is located at the second end of the motor shaft 122, and is provided with a second labyrinth sealing mechanism 141, so as to reduce the gas leakage from the side of the second impeller assembly 140 close to the motor cavity 121, thereby limiting the gas leaking from the side of the second impeller assembly 140 close to the motor cavity 121 within a certain range. The first gas bearing assembly 150 is disposed between the motor cavity 121 and the first impeller assembly 130, and the second gas bearing assembly 160 is disposed between the motor cavity 121 and the second impeller assembly 140.

It should be noted that the first labyrinth sealing mechanism 131 is kept in gas communication with the first gas bearing assembly 150, so that the gas leaking from the side of the first impeller assembly 130 close to the motor cavity 121 can be supplied to the first gas bearing assembly 150 to ensure that the first gas bearing assembly 150 obtains adequate gas supply, lubrication and cooling. And, the second labyrinth sealing mechanism 141 is kept in gas communication with the second gas bearing assembly 160, so that the gas leaking from the side of the second impeller assembly 140 close to the motor cavity 121 can be supplied to the second gas bearing assembly 160 to ensure that the second gas bearing assembly 160 obtains adequate gas supply, lubrication and cooling. The present invention adopts the design of combining the labyrinth seal of the compressor impeller assembly with the gas bearing assembly, providing the gas leakage of the labyrinth seal to the gas bearing assembly, so there is no need to add additional elbows or drill holes in other components to create gas supply channels. The centrifugal compressor according to the present invention can meet the gas supply requirements of the gas bearing assembly in a simple and economical manner.

In an embodiment of the centrifugal compressor according to the present invention, the first gas bearing assembly 150 may comprise a first bearing seat 151 and a first radial bearing 152, wherein the first bearing seat 151 is fixed between the motor cavity 121 and the first impeller assembly 130, and the first radial bearing 152 is sleeved on the motor shaft 122 and located in the first bearing seat 151 (see FIG. 2). The second gas bearing assembly 160 may comprise a second bearing seat 161 and a second radial bearing 162, wherein the second bearing seat 161 is fixed between the motor cavity 121 and the second impeller assembly 140, and the second radial bearing 162 is sleeved on the motor shaft 122 and located in the second bearing seat 161 (see FIG. 3).

In order to counteract the axial force caused by the axial movement, the second gas bearing assembly 160 further comprises a thrust plate 163, a first axial thrust bearing 164 and a second axial thrust bearing 165. The thrust plate 163 is fixed on the motor shaft 122 and is located between the second impeller assembly 140 and the second radial bearing 162. The first axial thrust bearing 164 is disposed next to one side of the thrust plate 163. The second axial thrust bearing 165 is disposed next to the other side of the thrust plate 163, wherein the first axial thrust bearing 164 and the second axial thrust bearing 165 are coaxially fixed in the second bearing seat 161 or the second impeller housing. When the motor is working, the thrust plate 163 rotates at a high speed with the motor shaft, and forms a gas film with the foil structures of the first axial thrust bearing 164 and the second axial thrust bearing 165 on both sides, providing the effect of balancing the axial force. It should be noted that the position of the thrust plate can be adjusted flexibly. In addition to being disposed between the second impeller assembly 140 and the second radial bearing 162, the thrust plate can also be disposed between the motor cavity 121 and the second radial bearing 162.

As an alternative, a thrust plate can also be provided on the side of the first gas bearing assembly. For example, the first gas bearing assembly comprises: a thrust plate fixed on the motor shaft and located between the first impeller assembly and the first radial bearing or between the motor cavity and the first radial bearing; a first axial thrust bearing disposed next to one side of the thrust plate; and a second axial thrust bearing disposed next to the other side of the thrust plate, wherein the first axial thrust bearing and the second axial thrust bearing are coaxially fixed in the first bearing seat or the first impeller housing.

Those skilled in the art can appreciate that, during operation of the centrifugal compressor 100, in order to cool the motor, holes are usually drilled in the housing of the motor to introduce a certain amount of refrigerant. Flash evaporation occurs through these holes to cool the motor, and the internal pressure of the motor cavity 121 is relatively low. In order to prevent droplets splashed from the motor cavity 121 from entering the first gas bearing assembly 150, a first wire mesh 170 is provided between the motor cavity 121 and the first gas bearing assembly 150. Meanwhile, in order to prevent droplets splashed from the motor cavity 121 from entering the second gas bearing assembly 160, a second wire mesh 180 is provided between the motor cavity 121 and the second gas bearing assembly 160. As an alternative, a first baffle plate may also be provided on the side of the first bearing seat 151 close to the motor cavity 121. By blocking the gas inlet end of the first gas bearing assembly 150, the droplets from the motor cavity 121 can be effectively prevented from entering the first gas bearing assembly 150. Similarly, a second baffle plate may also be provided on the side of the second bearing seat 161 close to the motor cavity 121. By blocking the gas inlet end of the second gas bearing assembly 160, the droplets from the motor cavity 121 can be effectively prevented from entering the second gas bearing assembly 160. In addition, it is also possible to prevent the droplets in the motor cavity from being sucked into the gas bearing by controlling and designing the outlet pressure on the side of the gas bearing close to the motor cavity, i.e., to make it greater than the pressure in the motor cavity. Specifically, the outlet pressure on the side of the first gas bearing assembly close to the motor cavity is greater than the pressure in the motor cavity, and the outlet pressure on the side of the second gas bearing assembly close to the motor cavity is greater than the pressure in the motor cavity.

In the embodiment shown in FIGS. 2 to 3, the first labyrinth sealing mechanism 131 is provided on one or more of a fixed portion of the end of the first impeller of the first impeller assembly 130, the first impeller housing 132 and the first bearing seat 151; and the second labyrinth sealing mechanism 141 is provided on one or more of a fixed portion of the end of the second impeller of the second impeller assembly 140, the second impeller housing 142 and the second bearing seat 161. The first impeller housing 132 comprises suction chamber fasteners, volute fasteners, or other fasteners connected thereto. Similarly, the second impeller housing 142 comprises suction chamber fasteners, volute fasteners, or other fasteners connected thereto.

To facilitate manufacture, the first radial bearing 152 of the first gas bearing assembly 150 and the second radial bearing 162 of the second gas bearing assembly 160 are configured to be of the same size, and are symmetrically disposed on both sides of the motor shaft 122 with respect to the motor cavity 121. Of course, it is also feasible to configure the two to be of different sizes. Similarly, the first wire mesh 170 and the second wire mesh 180 can also be configured to be of the same size, and be symmetrically disposed on both sides of the motor shaft 122 with respect to the motor cavity 121.

To sum up, the centrifugal compressor according to the present invention, by adopting the design of combining labyrinth seal of the impeller assembly with gas bearing, advantageously meets the gas supply requirements of the gas bearing by supplying the gas leakage generated by the labyrinth seal to the gas bearing, without adding additional gas supply pipes and drilling holes in other existing components.

In addition, the present invention further provides a refrigerating system configured with the aforementioned centrifugal compressor. The refrigerating system may comprise a cooling tower, a water chiller, a pumping device, and the like that are connected by pipelines, wherein the water chiller is composed of components such as centrifugal compressor, condenser, throttling device and evaporator. As mentioned above, the aforementioned centrifugal compressor can effectively achieve the purpose of supplying gas to the gas bearing without additional manufacturing cost, so it is highly recommended to apply the aforementioned centrifugal compressor to various refrigeration systems.

Some specific embodiments are listed above to illustrate in detail a centrifugal compressor and a refrigeration system configured with the centrifugal compressor according to the present invention. These individual examples are only used to illustrate the principle of the present invention and the implementations thereof, but not to limit the present invention. Those skilled in the art may, without departing from the spirit and scope of the present invention, make various modifications and improvements. Therefore, all equivalent technical solutions shall belong to the scope of the present invention and be defined by the various claims of the present invention.

What is claimed is:

1. A centrifugal compressor, comprising:

a housing;

a motor assembly disposed in the housing and comprising a motor cavity and a motor shaft located in the motor cavity, the motor shaft having a first end and a second end extending from the motor cavity;

a first impeller assembly located at the first end of the motor shaft and provided with a first labyrinth sealing mechanism for reducing gas leakage from one side of the first impeller assembly;

a second impeller assembly located at the second end of the motor shaft and provided with a second labyrinth sealing mechanism for reducing gas leakage from one side of the second impeller assembly;

a first gas bearing assembly provided between the motor cavity and the first impeller assembly; and a second gas bearing assembly provided between the motor cavity and the second impeller assembly;

wherein the first labyrinth sealing mechanism is kept in gas communication with the first gas bearing assembly, such that the gas leaking from the side of the first impeller assembly is supplied to the first gas bearing assembly, and the second labyrinth sealing mechanism is kept in gas communication with the second gas bearing assembly, such that the gas leaking from the side of the second impeller assembly is supplied to the second gas bearing assembly;

wherein a first wire mesh is provided between the motor cavity and the first gas bearing assembly for preventing droplets from the motor cavity from entering the first gas bearing assembly, the first wire mesh extending radially outwardly from the motor shaft, and a second wire mesh is provided between the motor cavity and the second gas bearing assembly for preventing droplets from the motor cavity from entering the second gas bearing assembly, the second wire mesh extending radially outwardly from the motor shaft.

2. The centrifugal compressor according to claim 1, wherein:

the first gas bearing assembly comprises: a first bearing seat fixed between the motor cavity and the first impeller assembly; and a first radial bearing sleeved on the motor shaft and located in the first bearing seat; and the second gas bearing assembly comprises: a second bearing seat fixed between the motor cavity and the second impeller assembly; and a second radial bearing sleeved on the motor shaft and located in the second bearing seat.

3. The centrifugal compressor according to claim 2, wherein the second gas bearing assembly further comprises:

a thrust plate fixed on the motor shaft and located between the second impeller assembly and the second radial bearing or between the motor cavity and the second radial bearing;

a first axial thrust bearing disposed next to one side of the thrust plate; and a second axial thrust bearing disposed next to the other side of the thrust plate, wherein the first axial thrust bearing and the second axial thrust bearing are coaxially fixed in the second bearing seat or a second impeller housing.

4. The centrifugal compressor according to claim 2, wherein the first gas bearing assembly further comprises:

a thrust plate fixed on the motor shaft and located between the first impeller assembly and the first radial bearing or between the motor cavity and the first radial bearing;

a first axial thrust bearing disposed next to one side of the thrust plate; and a second axial thrust bearing disposed next to the other side of the thrust plate, wherein the first axial thrust bearing and the second axial thrust bearing are coaxially fixed in the first bearing seat or a first impeller housing.

5. The centrifugal compressor according to claim 1, wherein outlet pressure on one side of the first gas bearing assembly is greater than pressure in the motor cavity, and outlet pressure on one side of the second gas bearing assembly is greater than pressure in the motor cavity.

6. The centrifugal compressor according to claim 2, wherein the first labyrinth sealing mechanism is provided on one or more of a fixed portion of an end of a first impeller of the first impeller assembly, a first impeller housing and the first bearing seat; and the second labyrinth sealing mechanism is provided on one or more of a fixed portion of an end of a second impeller of the second impeller assembly, a second impeller housing and the second bearing seat.

7. The centrifugal compressor according to claim 2, wherein the first radial bearing of the first gas bearing assembly and the second radial bearing of the second gas bearing assembly are configured to be of the same size, and are symmetrically disposed on both sides of the motor shaft with respect to the motor cavity.

8. The centrifugal compressor according to claim 1, wherein the first wire mesh and the second wire mesh are configured to be of the same size, and are symmetrically disposed on both sides of the motor shaft with respect to the motor cavity.

9. A refrigeration system, wherein the refrigeration system comprises the centrifugal compressor according to claim 1.

* * * * *